US006182031B1

(12) United States Patent
Kidder et al.

(10) Patent No.: US 6,182,031 B1
(45) Date of Patent: Jan. 30, 2001

(54) SCALABLE AUDIO CODING SYSTEM

(75) Inventors: Jeffrey N. Kidder, Hillsboro, OR (US); Russell Henning, Phoenix, AZ (US); Michael E. Deisher, Hillsboro, OR (US)

(73) Assignee: Intel Corp., Santa Clara, CA (US)

( * ) Notice: Under 35 U.S.C. 154(b), the term of this patent shall be extended for 0 days.

(21) Appl. No.: 09/153,347

(22) Filed: Sep. 15, 1998

(51) Int. Cl.[7] ..... G10L 19/02
(52) U.S. Cl. ..... 704/205; 704/500
(58) Field of Search ..... 704/203, 205, 704/224, 500, 503, 501, 504; 341/122; 375/256

(56) References Cited

U.S. PATENT DOCUMENTS

| | | | | |
|---|---|---|---|---|
| 4,569,075 | * | 2/1986 | Nussbaumer | 704/203 |
| 4,691,292 | * | 9/1987 | Rothweiler | 708/316 |
| 4,799,179 | * | 1/1989 | Masson et al. | 708/313 |
| 5,241,535 | * | 8/1993 | Yoshikawa | 704/229 |
| 5,253,058 | * | 10/1993 | Gharavi | 348/415 |
| 5,412,690 | * | 5/1995 | Kotzin et al. | 375/256 |
| 5,568,142 | * | 10/1996 | Velazquez et al. | 341/126 |
| 5,819,215 | * | 10/1998 | Dobson et al. | 704/230 |
| 5,984,514 | * | 11/1999 | Greene et al. | 708/203 |

OTHER PUBLICATIONS

Rabiner et al., "Digital Processing of Speech Signals," Prentice–Hall, Inc., 1978, pp. 261, 324 and 325.*

Chen et al., "Design of Quadrature Mirror Filters with Linear Phase in the Frequency Domain," IEEE Transactions on Circuits and Systems—II: Analog and Digital Signal Processing, vol. 39, No. 9, pp. 593–605, Sep. 1992.*

Xu et al., "Efficient Iterative Design Method for Cosine–Modulated QMF Banks," IEEE Transactions on Signal Processing, vol. 44, No. 7, pp. 1657–1668, Jul. 1996.*

H.S. Malvar, "Modulated QMF Filter Banks with Perfect Reconstruction," Electronics Letters, vol. 26, No. 13, pp. 906–907, Jun. 1990.*

Recommendation G.722 "7kHz Audio–Coding Within 64 KBIT/S" (Melbourne, 1988), pp. 269 to 339.

"Multirate Systems and Filter Banks," P.P. Vaidyanathan, Dept. of Electrical Engineering California Institute of Technology Pasadena, 1993, Part 2: Section 5.

* cited by examiner

*Primary Examiner*—Tālivaldis I. Šmits
*Assistant Examiner*—Martin Lerner
(74) *Attorney, Agent, or Firm*—Kenyon & Kenyon

(57) ABSTRACT

An audio coding system encodes and decodes audio signals as a plurality of independent layers of coded audio data. A basic representation of the original audio signal may be reconstructed from decoding of a single layer of coded audio data. However, a more complete representation of the original audio signal is reconstructed by decoding additional layers of coded audio data. The coding system finds application with decoding systems of varying processing power, and in transmission systems having communication channels that are characterized by intermittent transmission errors and/or variable capacity. At an encoding system, an audio signal is broken into a plurality of frequency bands which are filtered, down sampled and independently coded. A decoding system inverts the coding process applied at the encoding system for whatever number of layers that is determined will be decoded.

21 Claims, 4 Drawing Sheets

SCALABLE AUDIO CODING SYSTEM

BACKGROUND

The present invention relates to a scalable audio coding system in which an audio signal is coded as a plurality of independent layers.

"Audio coding" refers generally to the art of representing audio signals in an efficient manner. Typically, an input audio signal (analog or digital) is coded as a digital signal that occupies less bandwidth than the original signal. An encoding system codes the original audio signal into coded audio data. Sometime later, a decoding system decodes the coded audio data and generates a reconstructed audio signal therefrom.

A variety of audio coders are known in the art. Each may possess relative efficiencies over others in certain coding contexts. Some audio coding systems, for example, are quite simple in implementation and require little processing power by either an encoding system or a decoding system. However, the simple coding systems may not code audio data signals very efficiently. Other, more powerful coding systems may code audio data signals efficiently but may be very complex in implementation. The complicated coding systems may require encoding systems and decoding systems to be very powerful. Often, the design of an audio coding system is impacted directly by the types of audio signals that are to be coded, the bandwidth available for transmission of coded audio data and the processing power of either the encoding system or the decoding system.

Increasingly, particularly in multi-media applications for wide area networks, it is not possible to determine the types of audio signals that will be coded, the bandwidth available for coded audio data or the processing power of decoding systems. In fact, coded audio data may be delivered over channels having variable bandwidth to decoding systems having variable processing power. To code audio signals in a manner that uses the resources of a powerful decoding system effectively, an encoding system may have to encode the audio signal according to a first coding scheme. However, to code an audio signal in a manner that does not overwhelm the resources of a less powerful decoding system, an encoding system may have to code the audio signal according to a second, more rudimentary audio coding scheme. Such repetitive encoding of a single audio signal leads to inefficient use of the encoding system. Accordingly, there is a need in the art for an audio coding system that provides for flexible coding of audio signals. Such a coding system should encode audio signals in a manner that permits rudimentary decoding systems to reconstruct an audio signal from the coded audio data. However, the audio coding system should also represent the audio signal in a manner that effectively uses the resources of a more powerful decoding system. Further, the audio coding system should permit an encoding system to code audio signals only once in such a manner that it is applicable for use with both rudimentary and powerful decoding systems.

SUMMARY

Embodiments of the present invention provide a scalable audio coding system in which audio signals are coded into a plurality of independent layers of coded audio data.

DETAILED DESCRIPTION

The present invention provides advantages over known audio coding systems by coding audio signals in a plurality of layers. A basic representation of the original audio signal may be obtained from decoding of just one of the coded layers. However, if multiple layers are decoded, a higher quality representation of the audio signal is obtained. The multi-layer coding scheme advantageously finds use with a variety of coders and a variety of bandwidth limitations. A simple decoding system may have sufficient processing power to decode only a single coded layer while a more powerful decoding system may decode multiple coded layers. Similarly, a single coded layer of audio may be transmitted through a limited bandwidth channel but additional coded layers may be transmitted through larger bandwidth channels. Also, channel errors that impact one of the coded layers may not affect other coded layers. Loss of a channel because of such errors result in a graceful degradation of signal quality rather than a complete loss of signal as may occur in prior art systems.

Figure 1:
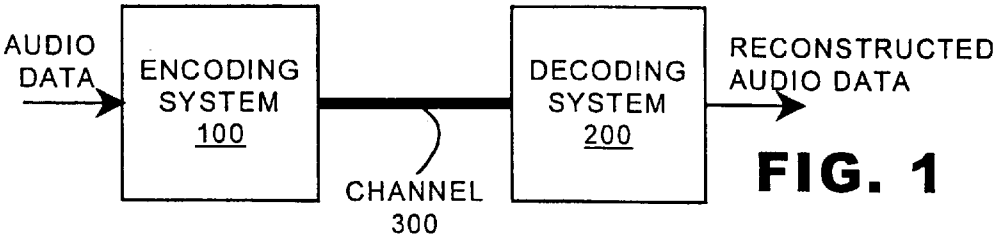
FIG. 1 is a block diagram of an audio coding system constructed in accordance with an embodiment of the present invention.

FIG. 1 illustrates a coding system constructed in accordance with an embodiment of the present invention. The system is populated by an encoding system 100 and a decoding system 200. The encoding system 100 receives an input audio signal to be coded. It outputs a signal including layers of coded audio data to a channel 300. The channel 300 may be a radio channel, a communication link established by a computer network or a storage medium such as an electrical, magnetic or optical memory. The decoding system 200 retrieves one or more layers of coded audio data from the channel 300. It decodes the layers and outputs a reconstructed audio signal.

Figure 2:
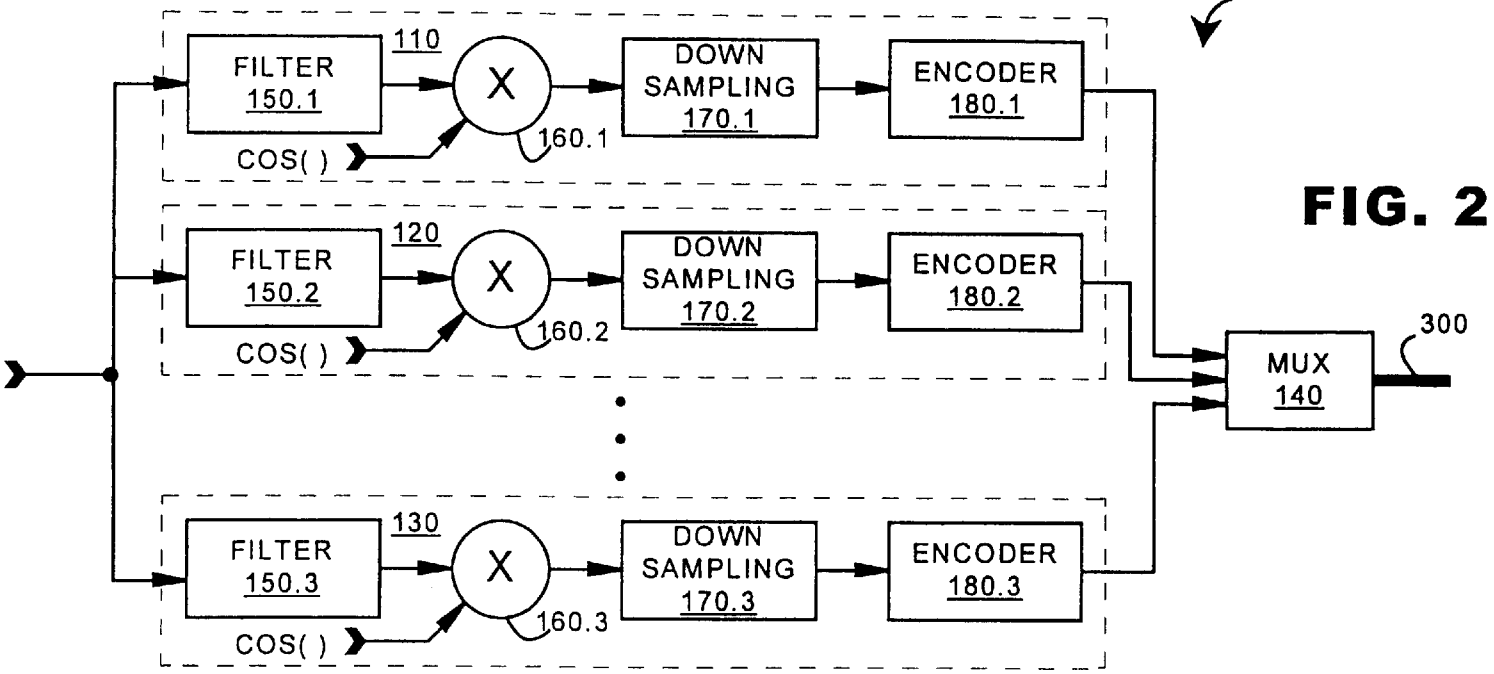
FIG. 2 is a block diagram of an encoding system constructed in accordance with a first embodiment of the present invention.

FIG. 2 illustrates an encoding system 100 constructed in accordance with the present invention. Components of the encoding system 100 may be provided as hardware devices or as a logical machine in a general purpose processor or digital signal processor operating according to software command. In either case, the encoding system 100 includes a plurality of encoding layers 110–130. Any number of encoding layers 110–130 may be provided in a given encoding system 100; the number typically will be determined by the coding applications for which the encoding system 100 may be used. An input audio signal propagates to an input of each of the encoding layers 110–130. An output of each encoding layer 110–130 may be input to a multiplexer 140. The multiplexer 140 assembles the layers into a unitary signal to be output to the channel 300. As will be shown below, the multiplexer 140 may be omitted in certain embodiments. When omitted, the coded data output from each encoding layer 110–130 may be output to separate channels (not shown).

Each encoding layer 110–130 may be constructed similarly. The input audio data is input to filters 150.1–150.3 of each layer 110–130. An output of each filter 150.1–150.3 is input to a respective baseband modulator 160.1–160.3. The output of each baseband modulator 160.1–160.3 is input to a respective downsampler and filter 170.1–170.3 ("downsampler"). An output of each downsampler 170.1–170.3 is input to a respective signal encoder 180.1–180.3. Although the types of signal encoders 180.1–180.3 may differ among the various encoding layers 110–130, it is advantageous to make them identical to simplify implementation.

Figure 3:
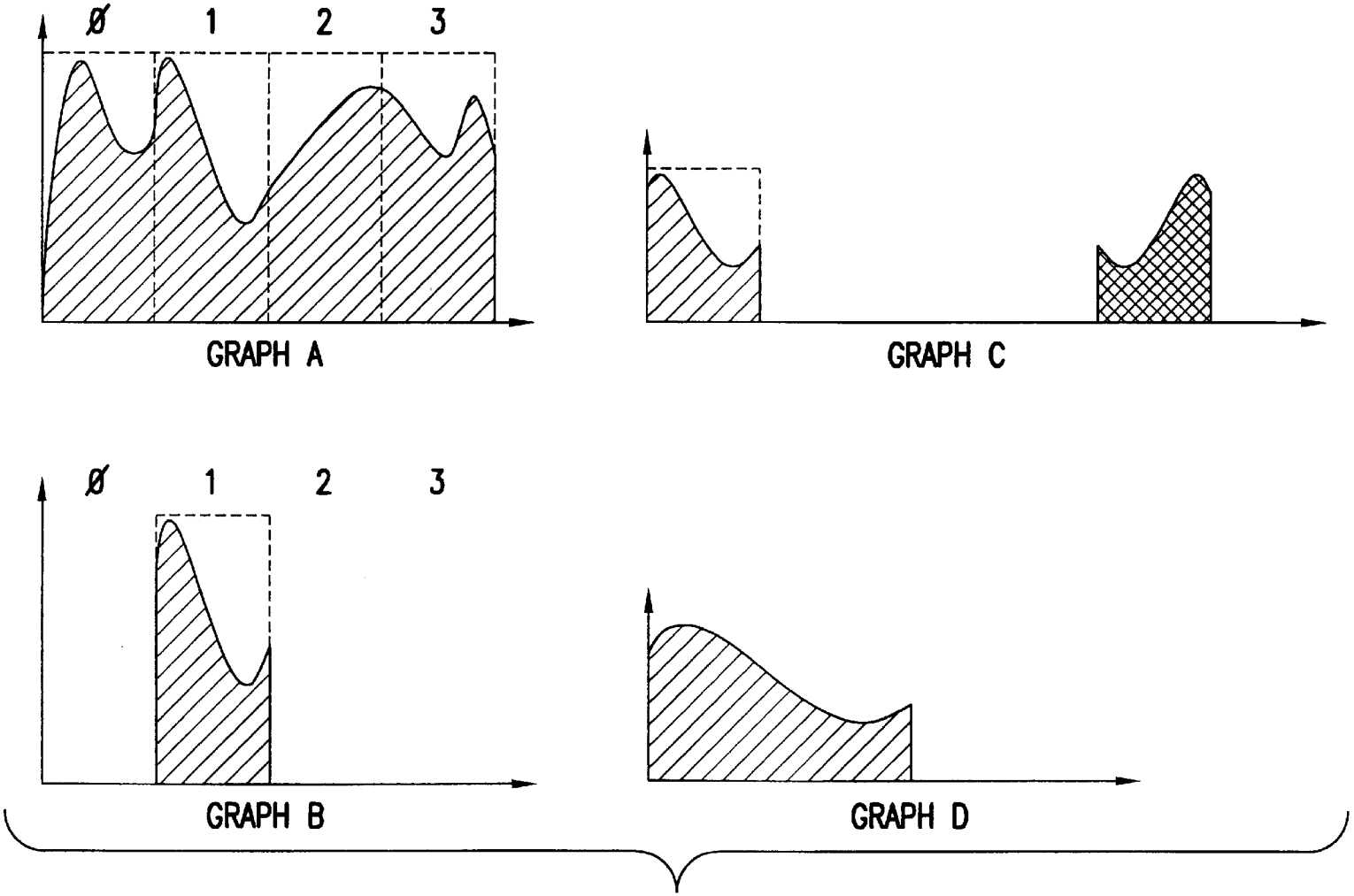
FIG. 3 illustrates processing of an exemplary audio signal at various stages of the encoding system of FIG. 2.

FIG. 3 illustrates processing that may be performed by an exemplary four layer encoding system 100 on an exemplary input audio signal. Graph A illustrates a frequency domain representation of the audio data signal input to the encoding system 100. The filters 150.1–150.3 divide the audio data signal into frequency bands Ø–3, identified by phantom lines in Graph A. More specifically, the filters 150.1–150.3 each bandpass filter the input audio data signal to isolate a respective frequency band for processing in the layer. Encoding layer 120, for example, selects frequency band 1 from Graph A. A frequency domain representation of a signal output from an idealized filter 150.1 in encoding layer 120 is shown in Graph B.

The baseband modulators 160.1–160.3 shift the isolated frequency bands in each layer to a baseband frequency. For example, the output of the filter 150.2 in encoding layer 120 is shifted from band 1 to band Ø. A frequency domain representation of the signal output from baseband modulator 160.2 is shown in Graph C. Similarly, in other coding layers, the frequency bands 2, 3, etc., are shifted to frequency band Ø. In one embodiment, the baseband modulators 160.1–160.3 may be multipliers each of which multiplies the signal from the respective filter 150.1–150.3 with a cosine function $$\cos\left(\frac{n * F_s}{2N}\right),$$

where n is the layer number in which the baseband modulator lies, $F_5$ is an original sampling rate of the audio data and N is the total number of coding layers in the encoding system 100.

When the input audio signal is a digital signal represented by a predetermined number of samples, the filters 150.1–150.3 cause the total number of samples processed to increase. Consider an example where the input audio signal is represented by 44 kilosamples per second (0–22 KHz in the frequency domain). When the audio data is filtered into frequency bands, each frequency band is represented by 44 kilosamples per second. Effectively, the total number of kilosamples processed by the encoding system 100 increases by a factor of N, where N is the number of encoding layers. The downsamplers 170.1–170.3 reduce the sample rate of the signals output from the baseband modulators 160.1–160.3 by a factor of 1/N. A frequency domain representation of the signal output from downsampler 170.2 is shown in FIG. 3, Graph D.

The downsamplers 170.1–170.3 also may include bandpass filtering. As shown in Graph C, the baseband modulator 160.1–160.3 shift the data signals to the baseband frequency and may generate a second copy of the data signal in another frequency band. Before downsampling, it is preferable to filter the output of the baseband modulators 160.1–160.3 to eliminate these second copies. The downsamplers 170.1–170.3 may perform this function as needed.

The signal encoders 180.1–180.3 may be audio coders. They code the data signals output by the respective downsamplers 170.1–170.3. Any of a variety of known audio coders may be used, such as DPCM, ADPCM, MPEG-2 layer 3, MPEG-2 AAC, and Dolby AC-3.

The coded output of each coding layer 110–130 may be input to a multiplexer 140. The multiplexer 140 merges the coded output of each coding layer 110–130 into a unitary data signal and outputs it to the channel 300. The audio encoding system 100 may be incorporated into a multimedia application involving the coding of audio signals and signals from other sources such as video. In such a case, the multiplexer 140 may integrate the data of the various layers 110–130 with other data types for transmission through the channel 300.

While FIG. 3 illustrates frequency domain representations of signals at various stages in the encoding system 100 of FIG. 2, the actual processing performed by encoding system 100 may be performed in either a time-domain basis or a frequency domain-basis.

Figure 4:
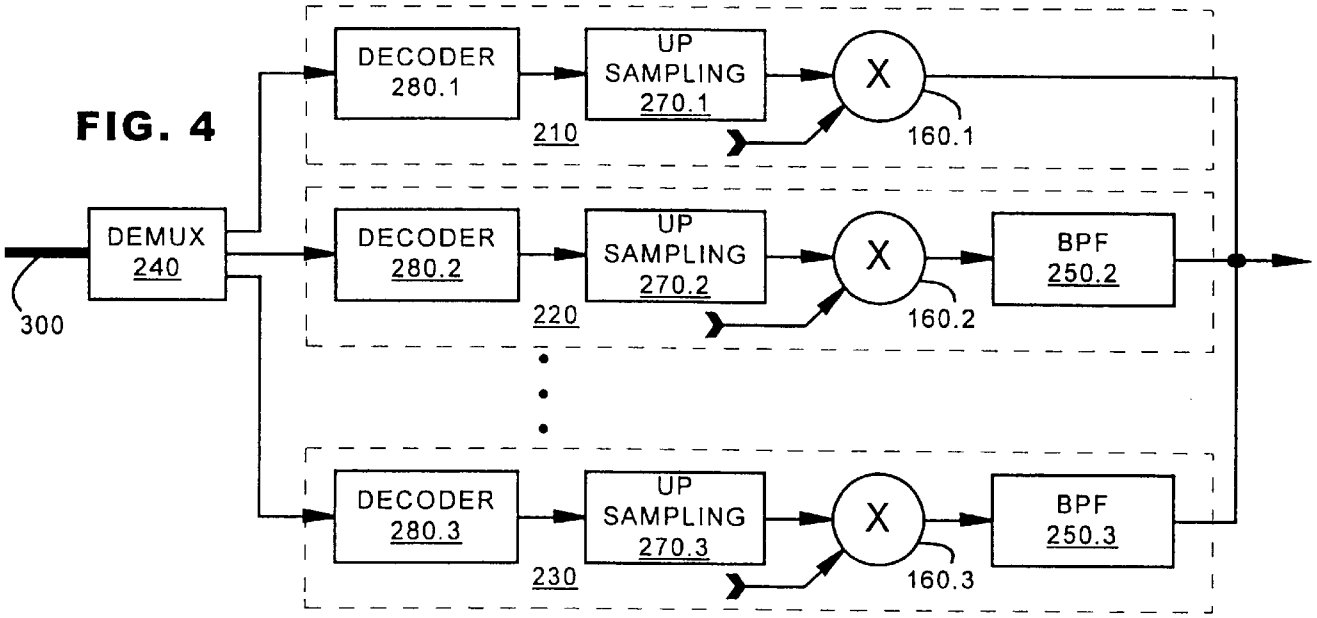
FIG. 4 is a block diagram of a decoding system constructed in accordance with a first embodiment of the present invention.

FIG. 4 illustrates a block diagram of a decoding system 200 constructed in accordance with an embodiment of the present invention. The decoding system 200 performs decoding to invert the coding applied by the encoding system 100. Decoding is performed on a layered basis. However, the decoding system 200 need not provide a decoding layer for every encoding layer 110–130 provided at the encoder 100 (FIG. 2).

In an embodiment, the decoding system 200 is arranged as a plurality of decoding layers 210–230. There may be as many as one decoding layer 210–230 provided for each layer of coded data present in the channel 300. Optionally, coded audio data is retrieved from the channel 300 by a demultiplexer 240. The demultiplexer 240 segregates the various layers of coded data from one another and forwards them to respective decoding layers 210–230. If the demultiplexer 240 is omitted, coded audio data from separate channels (not shown) may be input to the separate decoding layers 210–230. The decoding layers 210–230 decode the coded audio data and output a reconstructed audio signal therefrom.

The decoding layers 210–230 each may be populated by a decoder 280.1–280.3, an upsampler 270.1–270.3, a modulator 260.1–260.3 and a filter 250.1–250.3. Each inverts the encoding that was applied respectively to a layer of audio data. Within a decoding layer 220, the decoder 280.2 performs waveform decoding and outputs a decoded data signal therefrom. The upsampler 270.2 upsamples the decoded data signal by a factor of N, where N is the number of decoding layers 210–230 in the decoding system 200. The modulator 260.2 performs a frequency shift in a manner that inverts the baseband modulation applied at the encoding system 100 (FIG. 2). The bandpass filter 250.2 filters the output of the modulator 260. It outputs a reconstructed audio signal from the decoding layer 220. Outputs of each decoding layer may correspond in time and may be combined additively.

The layered structure of audio coding provides advantages because a decoding system 200 need not decode all layers present in the channel 300 to obtain an intelligible reconstructed audio signal. Instead, a decoding system 200 may decode only one layer to obtain a basic representation of the original audio signal. An audio signal that is reconstructed from fewer than all of the layers will possess a lower level of audio quality than one that is reconstructed from all of the layers.

The layered coding approach is advantageous because it is applicable with a variety of different decoding systems. For example, a simple decoding system may provide only a few decoding layers 210–230. It will decode a small number of the available layers of coded audio data and obtain a basic representation of the original audio signal. By contrast, a more powerful decoding system may provide a full number of decoding layers 210–230 to decode every layer of coded audio data. The more powerful decoding system would obtain a higher quality representation of the original audio data.

As a further advantage of the present invention, the layered coding structure effectively provides a variable rate coding format even though the encoding system 100 codes the audio data only once. A decoding system 200 may select how many different coding layers out of the channel 300 that it will decode.

As another advantage of the present invention, the layered coding structure also provides for a graceful degradation in audio quality in the presence of channel errors. Channel errors may garble the coded audio data that is retrieved from the channel 300 by a decoding system 200. Within each coding layer 210–230, a decoder 280.1–280.3 may be programmed to recognize and/or repair channel errors. If the decoder 280.1–280.3 determines that its layer of coded audio data has experienced an unrecoverable transmission error, the decoder 280.1–280.3 may cease decoding until the error concludes. If the errors do not affect other decoding layers, the reconstructed audio signal may be generated from the remaining decoding layers. In effect, the decoding layer that experienced the error temporarily "drops out" of decoding until the error concludes. Consequently, the quality of the reconstructed audio temporarily degrades until the error concludes. By contrast, prior art coding systems experience a loss of signal when unrecoverable channel errors occur.

Yet another advantage of the present invention may be achieved by routing components that create the communication channels 300 in, for example, a computer network. "Smart routers" may be programmed to recognize signal formats as well as channel congestion events. When channel congestion is detected, a smart router may be programmed to prioritize base layers of audio data over other layers. Just as channel errors may introduce a graceful degradation of quality in the reconstructed audio signal, channel congestion can cause coded layers to be dropped from transmission and introduce the same kind of graceful degradation.

And another advantage of the present invention lies in the fact that the layers are coded independently. Because each layer is coded independently from the other layers, the loss of any layer (due to channel errors or congestion, for example) does not prevent the decoding system 200 from decoding the remaining layers. While the loss of the frequency bands associated with a given layer may impact the perceived quality of reconstructed audio (for example, the loss of bass frequencies in music often causes the music to be characterized as "tinny"), it does not impair the decoding system's ability to decode the remainder of the coded audio data.

Figure 5:
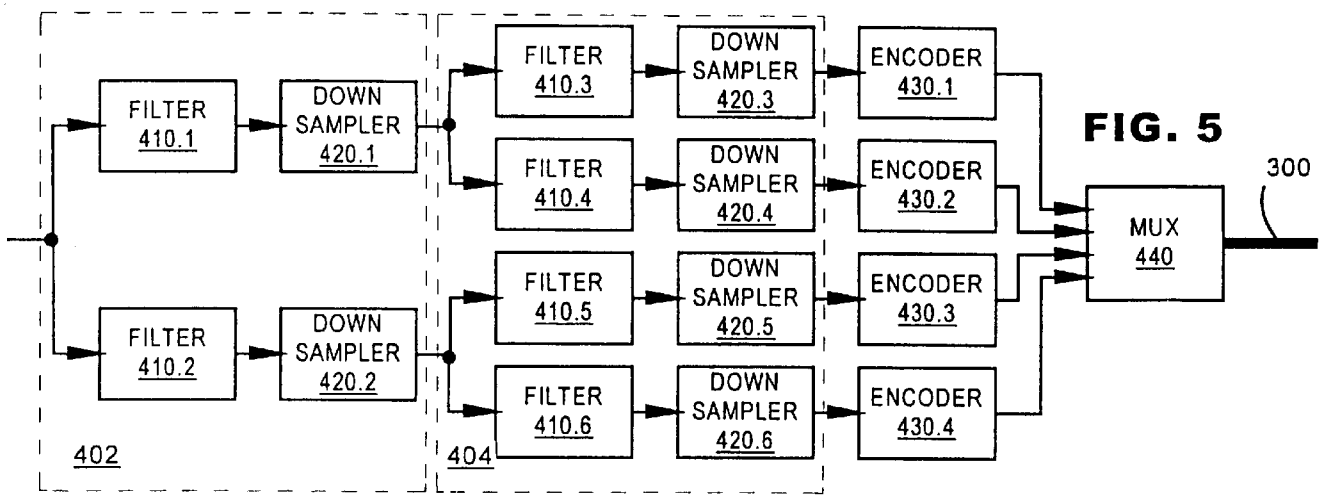
FIG. 5 is a block diagram of an encoding system constructed in accordance with a second embodiment of the present invention.

FIG. 5 illustrates a second embodiment of an encoding system 400 of the present invention. There, an input audio signal is broken down into layers incrementally by stages 402, 404. Once the audio signal is broken down into a predetermined number of frequency bands, each band may be encoded as in the first embodiment. This second embodiment omits the baseband modulator 160 of the encoding system 100 of FIG. 1.

To break the input audio signal into bands, the encoding system 400 includes a first stage 402 of filters 410.1–410.2 and downsamplers 420.1–420.2. The first stage 402 breaks the input audio data into two frequency components, each of which is shifted to baseband frequencies. The filters 410.1–410.2 may be complementary quadrature mirror filters. The downsamplers 420.1–420.2 each remove every second sample from the filtered data stream.

A second stage 404 of filters 410.3–410.6 and downsamplers 420.3–420.6 are shown in the embodiment of FIG. 5. Each frequency band output from the first stage is itself split into two frequency components, each of which is shifted to baseband frequencies. Although only two stages 402, 404 are shown in FIG. 5, an encoding system 400 may includes as many stages as are desired for a particular coding application. In this second embodiment, M stages 402, 404 yield $2^M$ layers of coded audio data.

The signals output from the final stage comprise the layers of audio signals to be coded. The audio signals of each layer are input to respective encoders 430.1–430.4. The encoders 430.1–430.4 code the audio signals and output coded audio data. A multiplexer 440 may be provided to assemble the layers of coded audio data into a unitary signal.

The encoding system 400 omits the baseband modulator 160 of FIG. 1. The output of each filter 410.1–410.6 is shifted to baseband frequency as part of the filtering process. As is known, certain filters may output the respective audio signal at baseband but having inverted its frequency characteristics. That is, formerly high frequency components are shifted to lower baseband frequencies than formerly low frequency components.

Figure 6:
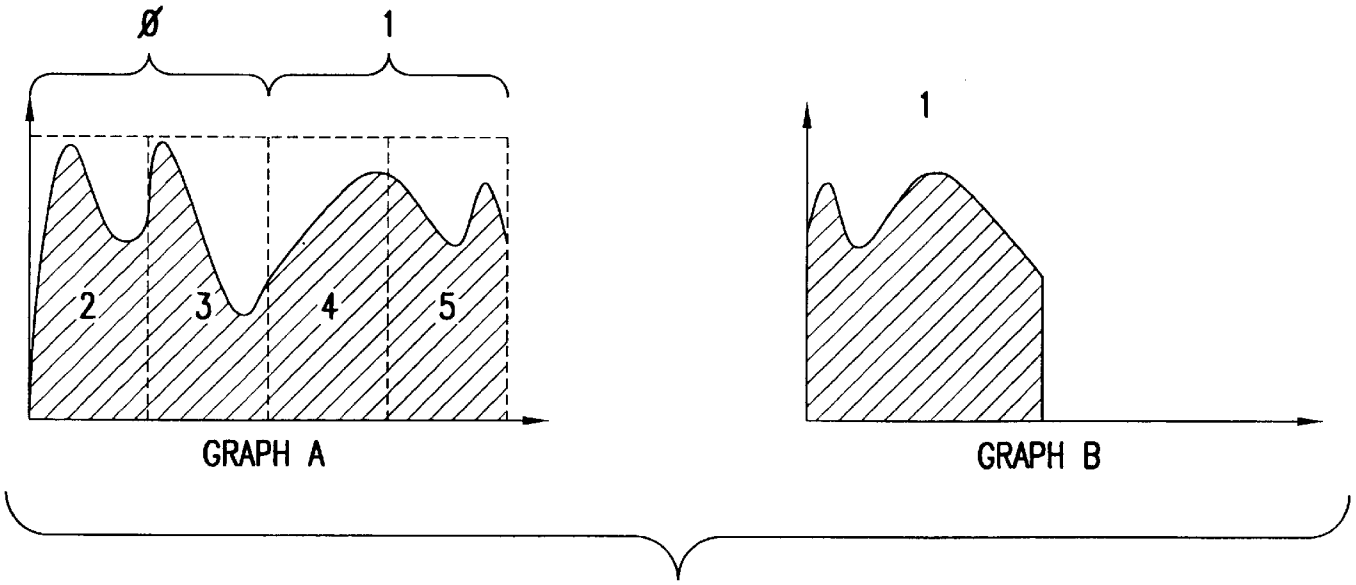
FIG. 6 illustrates processing of audio signals at various stages of processing in the encoding system of FIG. 5.

An example of this phenomenon is shown graphically in FIG. 6. Graph A represents the exemplary input audio signal of FIG. 3. The first stage 404 divides the audio signal into bands Ø and 1; the second stage respectively divides band Ø into band 2–3 and band 1 into bands 4–5. Graph B illustrates the signal output from filter 410.2. Band 1 is isolated by filter 410.2 but flipped in the frequency domain. The flipped version of band 1 is input to the second stage 404 filters 410.5–410.6, one of which will flip its respective band again.

Figure 7:
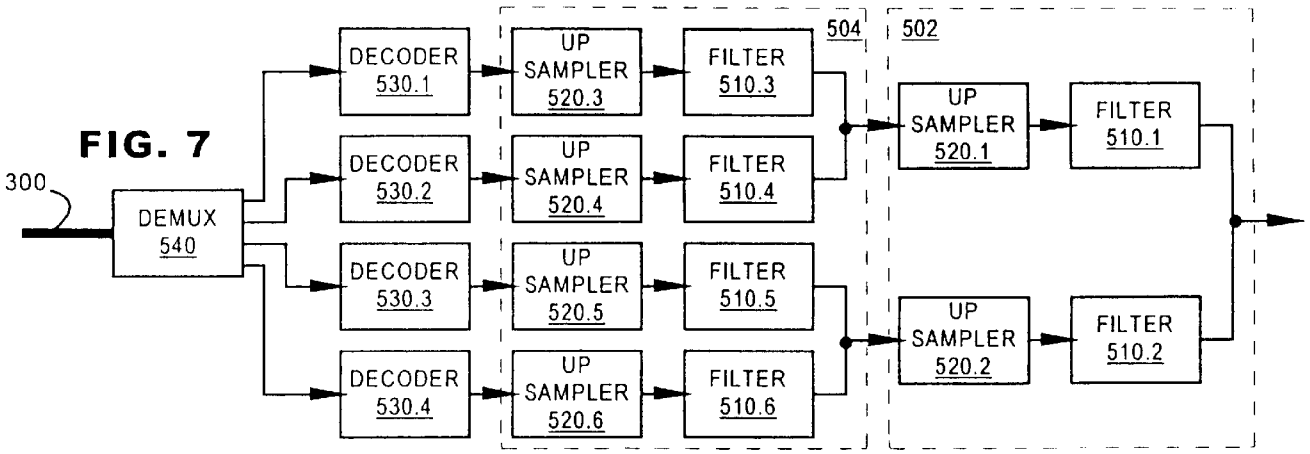
FIG. 7 is a block diagram of a decoding system constructed in accordance with a second embodiment of the present invention.

FIG. 7 illustrates a decoding system 500 constructed in accordance with a second embodiment of the present invention. The decoding system 500 inverts the encoding that had been applied by the encoding system 400 of FIG. 5. The decoding system 500 includes a plurality of filters 510.1–510.6 and upsamplers 520.1–520.6 arranged in stages 502, 504 in correspondence with the filters and downsamplers of the encoding system 400.

Coded audio data is retrieved from the channel 300 by a demultiplexer 540. The demultiplexer 540 segregates each layer of coded audio data and routes the layers to respective decoders 530.1–530.4. The decoders 530.1–530.4 perform decoding to reverse the encoding that had been applied by encoders 430.1–430.4. The decoders 530.1–530.4 output layers of reconstructed audio data.

Stages 502, 504 of filtering and upsampling reassemble frequency bands in a manner that inverts the disassembly that had been applied at the encoding system. The audio signals output from the decoders 530.1–530.4 are input to stage 504 called the "second stage" to correspond to the second stage 404 at the encoding system 400. The upsamplers 520.3–520.6 insert zero value samples between each sample of reconstructed audio data output by the decoders 530.1–530.4. The filters 510.3–510.6 reverse the filtering that had been applied by the second stage 404 at the encoding system 400. If a filter 410.6 at the encoding system 400 had flipped the frequency characteristics of a layer of audio data, its associated filter 510.6 in the decoding system 500 flips it back. Similarly, the first stage 502 of filters 510.1–510.2 and upsamplers 520.1–520.2 invert the filtering and downsampling that had been applied by the first stage 402 at the encoding system 400. The first stage 502 outputs a reconstructed audio signal from the decoding system 500.

Again, as with the encoding system 100 and decoding system 200 of the first embodiment, the encoding system 400 and decoding system 500 of the second embodiment provide a coding scheme that finds application with a variety of different decoding systems. More powerful decoding systems decode more layers than less powerful decoding systems and, consequently, obtain a higher quality audio output. The coding scheme effectively provides for a variable coding rate even though an encoding system 400 codes audio data only once. And, as with the first embodiment, the second embodiment experiences a graceful degradation in audio output in the presence of channel errors and/or congestion.

As noted, the encoding systems 100, 400 and decoding systems 200, 500 may be implemented in hardware or software, or both. Hardware implementations of filters, modulators, downsamplers, upsamplers, encoders and decoders are well-known. So, too, are software implementations. It will be understood that software implementations of the present invention may not provide for true parallel processing as is shown in the drawings but rather will be performed in a time multiplexed fashion.

The provision of multiplexers 140, 440 and demultiplexers 240, 540 in the present invention depends upon the types of channels over which the layers of coded audio data will be transmitted. In a serial communication channel, the multiplexers 140, 440 and demultiplexers 240, 540 may assemble the coded layers into a unitary signal according to a time division multiplexing scheme. Conversely, where the channel 300 allows for parallel transmission of coded layers in parallel (for example, in a multi-channel system), the multiplexers 140, 440 and demultiplexers 240, 540 may be omitted.

Several embodiments of the present invention are specifically illustrated and described herein. However, it will be appreciated that modifications and variations of the present invention are covered by the above teachings and within the purview of the appended claims without departing from the spirit and intended scope of the invention.

Accordingly, embodiments of the present invention provide for a scalable audio coding system in which an audio signal is coded and decoded in independent layers.

We claim:

1. A method of coding an audio signal, comprising:

filtering the audio signal into filtered frequency bands, each frequency band independently selectable for decoding, frequency shifting the filtered audio signals each to a baseband frequency, downsampling the filtered audio signal, and coding the downsampled filtered audio signal.

2. The method of claim 1, wherein the coding step includes compressing the downsampled filtered audio signal.

3. The method of claim 1, wherein the filtering step includes quadrature mirror filtering.

4. The method of claim 1, wherein the audio signal is represented by a plurality of time samples and the downsampling step includes removing every second time sample.

5. The method of claim 1 wherein the frequency shifting is accomplished by multiplying each frequency band n by a cosine function $$\cos\left(\frac{n * F_s}{2N}\right),$$

where $F_s$ represents a sampling rate of audio data in the band and N represents the total number of audio bands in the audio coder.

6. A method of coding an audio signal, comprising:

inputting the audio signal to a first stage;

incrementally, through a plurality of stages, filtering the audio signal input to the respective stage into two frequency bands, each frequency band independently selectable for decoding, frequency shifting the filtered audio signals each to a baseband frequency, downsampling each band of shifted audio signals by a predetermined downsampling rate, for intermediate stages, inputting the downsampled bands of audio signals to a next stage; and coding the downsampled bands of audio signals output from the last of the plurality of stages.

7. The method of claim 6, wherein the coding step includes compressing the downsampled bands of audio signals.

8. The method of claim 6, wherein the filtering step includes quadrature mirror filtering.

9. The method of claim 6, wherein the audio signal is represented by a plurality of time samples and the downsampling step includes removing every second time sample.

10. The method of claim 6 wherein the frequency shifting is accomplished by multiplying each frequency band n by a cosine function $$\cos\left(\frac{n * F_s}{2N}\right),$$

where $F_s$ represents a sampling rate of audio data in the band and N represents the total number of audio bands in the audio coder.

11. A method of decoding coded audio data arranged as layers of coded audio data, comprising:

independently and selectively decoding at least a portion of the layers of coded audio data, upsampling the decoded layers, frequency shifting the upsampled layers from a baseband frequency to predetermined frequency bands, filtering the shifted layers, and assembling the filtered layers into a reconstructed audio signal.

12. The method of claim 11, wherein the decoding step includes decompressing the layers of coded audio data.

13. The method of claim 11, wherein the filtering step includes quadrature mirror filtering.

14. The method of claim 11, wherein the layers of decoded audio signals are represented by a plurality of time samples and the upsampling step includes adding a zero valued sample between every second time sample of decoded audio signals.

15. A data signal generated according to the steps of:

receiving an audio signal, filtering the audio signal to a plurality of frequency components, frequency shifting the filtered audio signals each to a baseband frequency, downsampling the frequency shifted signals, and coding the downsampled components as a plurality of independent layers of coded audio data, each layer independently selectable for decoding.

16. The data signal of claim 15, wherein the frequency shifting is accomplished by multiplying each frequency band n by a cosine function $$\cos\left(\frac{n * F_s}{2N}\right),$$

where $F_s$ represents a sampling rate of audio data in the band and N represents the total number of audio bands.

17. A computer readable medium having stored thereon computer instructions that when executed cause a computer to execute the following steps:

receive an audio signal, filter the audio signal into a plurality of frequency components, frequency shift the filtered audio signals each to a base-band frequency, downsample the frequency shifted signals, and code the downsampled components as a plurality of independent layers of coded audio data, each frequency band independently selectable for decoding.

18. The computer readable medium of claim 17, wherein the computer instructions cause the frequency shift by multiplying each frequency band n by a cosine function $$\cos\left(\frac{n * F_s}{2N}\right),$$

where $F_s$ represents a sampling rate of audio data in the band and N represents the total number of audio bands.

19. An audio encoding system, comprising:

an input, a plurality of encoding layers, each layer enabled to make at least a portion of the input independently selectable for decoding, and at least one layer including:

a filter coupled to the input, a frequency-shifting baseband modulator coupled to the filter, the modulator shifting data from a predetermined frequency band to a base band frequency band, a downsampler coupled to an output of the baseband modulator, and a signal encoder coupled to the downsampler.

20. The encoding system of claim 19, further comprising a multiplexer coupled to outputs of each coding layer.

21. An audio decoding system, comprising:

an input, a plurality of decoding layers, each layer independently and selectively decoding at least portion of the input, and at least one decoding layer including:

a decoder coupled to the input, an upsampler coupled to an output of the frequency shifter, a frequency-shifting modulator coupled to an output of the upsampler, the frequency-shifting modulator shifting upsampled data from a base-band frequency band to a predetermined frequency band, and a filter coupled to the output of the modulator.

* * * * *